US010578099B2

(12) United States Patent
Hoehne

(10) Patent No.: US 10,578,099 B2
(45) Date of Patent: Mar. 3, 2020

(54) COOLING DEVICE FITTED WITH A COMPRESSOR

(71) Applicant: Pressure Wave Systems GmbH, Munich (DE)

(72) Inventor: Jens Hoehne, Munich (DE)

(73) Assignee: Pressure Wave Systems GmbH, Taufkirchen (DE)

( * ) Notice: Subject to any disclaimer, the term of this patent is extended or adjusted under 35 U.S.C. 154(b) by 1502 days.

(21) Appl. No.: 14/168,140

(22) Filed: Jan. 30, 2014

(65) Prior Publication Data

US 2014/0147296 A1 May 29, 2014

Related U.S. Application Data

(63) Continuation of application No. PCT/EP2012/065183, filed on Aug. 2, 2012.

(30) Foreign Application Priority Data

Aug. 3, 2011 (DE) ..... 10 2011 080 377
Mar. 20, 2012 (DE) ..... 20 2012 100 995 U

(51) Int. Cl.
*F04B 53/16* (2006.01)
*F04B 41/06* (2006.01)
(Continued)

(52) U.S. Cl.
CPC ..... *F04B 53/16* (2013.01); *F04B 9/105* (2013.01); *F04B 19/22* (2013.01); *F04B 23/06* (2013.01);
(Continued)

(58) Field of Classification Search
CPC .... F04B 35/008; F04B 9/1035; F04B 49/002; F04B 35/00; F04B 35/01; F04B 35/04;
(Continued)

(56) References Cited

U.S. PATENT DOCUMENTS 1,307,210 A * 6/1919 Newcomb ..... F04B 25/00 290/52
3,640,082 A * 2/1972 Dehne ..... F02G 1/0445 417/439
(Continued)

FOREIGN PATENT DOCUMENTS

CH 167609 A 4/1932
CH 244433 4/1945
(Continued)

OTHER PUBLICATIONS

Office action from the Japanese Patent Office in the related foreign application JP2014-523333 dated May 31, 2016 (4 pages).
(Continued)

*Primary Examiner* — Alexander B Comley
(74) *Attorney, Agent, or Firm* — Imperium Patent Works; Darien K. Wallace

(57) ABSTRACT

A compressor device that periodically supplies compressed working gas to a cooling device loses less of the gas by not using rotary valves. The compressor device includes a compressor cylinder, a compensation container and a drive device with an hydraulic cylinder. The compressor cylinder includes a compressor element, such as a piston or membrane, that divides the compressor cylinder into first and second volumes. The first volume contains the gas that is compressed by the compressor element. The hydraulic cylinder has a piston that is coupled to the compressor element. The compensation container contains compensation fluid and is directly connected to the second volume. The compensation container is also connected to the first volume by a gas line with a non-return valve that opens in the direction of the first volume. The drive device allows the compressed gas to be provided at a frequency required for Gifford-McMahon and pulse-tube coolers.

25 Claims, 7 Drawing Sheets

(51) Int. Cl.

| | |
|---|---|
| ***F04B 9/105*** | (2006.01) |
| ***F04B 23/06*** | (2006.01) |
| ***F04B 45/053*** | (2006.01) |
| ***F04B 19/22*** | (2006.01) |
| ***F04B 43/06*** | (2006.01) |
| ***F04B 35/01*** | (2006.01) |

(52) U.S. Cl.
CPC ..... *F04B 41/06* (2013.01); *F04B 43/06* (2013.01); *F04B 45/053* (2013.01); *F04B 35/01* (2013.01)

(58) Field of Classification Search
CPC ..... F04B 9/105; F04B 9/109; F04B 9/1053–1056; F25B 9/00; F25B 31/023; F25B 9/14–145
USPC .... 417/390, 392, 393, 399, 401, 403, 410.1, 417/420, 439; 62/6, 520, 521
See application file for complete search history.

(56) References Cited

U.S. PATENT DOCUMENTS 4,368,008 A * 1/1983 Budzich ..... F01L 25/06 417/267
4,373,865 A * 2/1983 Budzich ..... F01L 25/06 417/244
4,515,516 A * 5/1985 Perrine ..... F04B 41/00 222/3
4,653,986 A * 3/1987 Ashton ..... F04B 49/002 417/243
4,761,118 A * 8/1988 Zanarini ..... F04B 9/115 417/254
4,911,618 A * 3/1990 Suganami ..... F04B 39/0005 417/439
5,324,175 A * 6/1994 Sorensen ..... F04B 9/133 417/254
5,993,170 A * 11/1999 Stevens ..... F04B 35/008 417/244
6,077,053 A * 6/2000 Fujikawa ..... F04B 39/064 417/399
6,652,243 B2 * 11/2003 Krasnov ..... F04F 1/06 417/101
6,938,426 B1 9/2005 Acharya et al. ..... 62/6
7,407,501 B2 * 8/2008 Zvuloni ..... A61B 18/02 128/898
7,413,418 B2 * 8/2008 Lane ..... F04B 9/133 417/392
8,522,538 B2 * 9/2013 Ingersoll ..... F04B 41/02 417/267
2003/0133810 A1 * 7/2003 Leppin ..... B21D 26/041 417/254
2008/0253910 A1 10/2008 Caughley et al. ..... 417/472
2010/0326062 A1 12/2010 Fong et al. ..... 60/325
2011/0219810 A1 * 9/2011 Longsworth ..... F25B 9/14 62/474
2012/0096845 A1 * 4/2012 Ingersoll ..... F04B 41/02 60/408

FOREIGN PATENT DOCUMENTS

| | | | |
|---|---|---|---|
| CH | 244433 | A | 4/1945 |
| DE | 633104 | | 4/1935 |
| DE | 69636732 | T2 | 12/1996 |
| DE | 10124931 | A1 | 5/2001 |
| DE | 10137552 | C1 | 8/2001 |
| DE | 102004020168 | | 4/2004 |
| DE | 602004004772 | T2 | 4/2004 |
| DE | 602004009726 | T2 | 7/2004 |
| DE | 112005003132 | T5 | 1/2005 |
| DE | 102005057986 | | 12/2005 |
| EP | 1407838 | | 6/2003 |
| JP | S57-157076 | A | 3/1981 |
| JP | S57-157076 | A | 3/1981 |
| JP | S61-93282 | A | 10/1984 |
| JP | S61-93282 | A | 10/1984 |
| JP | H06-323672 | A | 5/1993 |
| JP | H09-236343 | A | 2/1996 |
| JP | 2002-349433 | A | 5/2001 |
| JP | 2002-349433 | A | 5/2001 |
| JP | 2008-542671 | A | 4/2006 |
| JP | 2008-291865 | A | 5/2007 |
| WO | WO2006/112741 | | 4/2006 |

OTHER PUBLICATIONS

English translation of Office action from the Japanese Patent Office in the related foreign application JP2014-523333 dated May 31, 2016 (5 pages).
Office action from the European Patent Office in the related foreign application EP12745677.0 dated Mar. 3, 2015 (4 pages).
Search Report of the German Patent Office in the related foreign application DE202012100995.1 dated Oct. 11, 2012 (6 pages).
Office action of the German Patent Office in the related foreign application DE102011080377.7 dated Apr. 5, 2012 (6 pages).
Decision of Rejection from the Japanese Patent Office in the related foreign application JP2014-523333 dated Feb. 7, 2017 (4 pages).
English translation of the Decision of Rejection from the Japanese Patent Office in the related foreign application JP2014-523333 dated Feb. 7, 2017 (5 pages).

* cited by examiner

COOLING DEVICE FITTED WITH A COMPRESSOR

CROSS REFERENCE TO RELATED APPLICATION

This application is filed under 35 U.S.C. § 111(a) and is based on and hereby claims priority under 35 U.S.C. § 120 and § 365(c) from International Application No. PCT/EP2012/065183, filed on Aug. 2, 2012, and published as WO 2013/017669 A1 on Feb. 7, 2013, which in turn claims priority from German Application No. 102011080377.7, filed in Germany on Aug. 3, 2011, and from German Application No. 202012100995.1, filed in Germany on Mar. 20, 2012. This application is a continuation-in-part of International Application No. PCT/EP2012/065183, which is a continuation-in-part of German Application Nos. 102011080377.7 and 202012100995.1. International Application No. PCT/EP2012/065183 is pending as of the filing date of this application, and the United States is an elected state in International Application No. PCT/EP2012/065183. This application claims the benefit under 35 U.S.C. § 119 from German Application Nos. 102011080377.7 and 202012100995.1. The disclosure of each of the foregoing documents is incorporated herein by reference.

TECHNICAL FIELD

The present invention relates to a compressor device and to a cooling device fitted therewith and to a cooler unit fitted therewith.

BACKGROUND

Pulse tube coolers and Gifford-McMahon coolers are used for cooling nuclear spin tomographs, cryo-pumps and other equipment. FIG. 1 (prior art) shows how a conventional gas compressor, such as a helium compressor, is used in combination with a rotary valve or with rotation valves. A helium compressor 10 is connected via a high-pressure line 11 and a low-pressure line 12 to a rotary valve 13. On the output side, the rotary valve 13 is connected via a gas line 14 to a cooling device 15 in the form of a Gifford-McMahon cooler or a pulse tube cooler. The high-pressure side and the low-pressure side of the gas compressor 10 are alternately connected via the rotary valve 13 to the pulse tube cooler or to the Gifford-McMahon cooler. The rate at which compressed helium is introduced into and removed again from the cooling device 15 is in the range of 1 Hz. A disadvantage of such cooler and compressor systems is that the motor-driven rotary valve 13 causes losses of about 50% of the input performance of the compressor.

Acoustic compressors or high-frequency compressors are also known in which one or more pistons are put in linear resonance oscillations by a magnetic field. These resonance frequencies are in the range of a few 10 Hz and are therefore not suitable for being used with pulse tube coolers and Gifford-McMahon coolers for generating very low temperatures in the range of less than 10 K.

A compressor device is therefore sought that is more efficient than the combination of a gas compressor and a rotary valve. In addition, a cooling device and a cooler unit are sought that incorporate such a compressor device.

SUMMARY

A novel compressor device operates more efficiently than conventional compressor arrangements that employ rotary values. The novel compressor device is fitted with a cooling device. The compressor device combines a compressor arrangement with an electro-hydrostatic drive arrangement. A reciprocating compressor element periodically compresses a working medium, such as a gas, which is then allowed to expand again in the cooling device. For example, the compressor element is a piston. The drive arrangement is mechanically coupled to the reciprocating compressor element and thereby enables the compressed gas to be generated within a frequency range required for Gifford-McMahon coolers and for pulse-tube coolers. The electro-hydrostatic drive arrangement and the compressor element are coupled by a mechanical or a magnetic coupling. This eliminates the need to use high-loss generating rotary valves. The combination of simple controllability of an electric motor and the force of an hydraulic mechanism can be applied to build an extremely efficient compressor that, due to the absence of a rotary valve when used with a Gifford-McMahon cooler or pulse-tube cooler, results in considerably lower losses. A highly-efficient compressor arrangement is thus provided.

The novel compressor device periodically supplies compressed working gas to a cooling device and loses less of that gas by not using rotary valves. For example, the working gas is helium, which is expensive. The compressor device includes a compressor cylinder, a compensation container and a drive device with a hydraulic cylinder. The compressor cylinder includes a compressor element that divides the compressor cylinder into a first volume and a second volume. The first volume contains the working gas that is compressed by the compressor element. The first volume is connected via a gas line to the cooling device, which receives the compressed working gas from the first volume. The hydraulic cylinder has an hydraulic piston that is coupled to the compressor element. The compensation container contains compensation fluid and is directly connected to the second volume. The compensation container is also connected to the first volume by a gas line with a non-return valve that opens in the direction of the first volume. The drive device allows the compressed gas to be provided at a frequency required for Gifford-McMahon and pulse-tube coolers.

The compressor element can be a piston or a membrane, such as a metallic membrane. The compressor element can also include a bellows. In one embodiment, the hydraulic piston is coupled to the compressor element by a rigid rod. The compressor piston can be an integral part of the rigid rod, such as when the compressor piston is formed by an end of the rigid rod opposite the hydraulic piston. In another embodiment, instead of being mechanically coupled by a rigid rod, the hydraulic piston and the compressor piston are magnetically coupled. The hydraulic piston divides the hydraulic cylinder into a first partial volume and a second partial volume. In one embodiment, the first partial volume of the hydraulic cylinder and the second volume of the compressor cylinder are connected by an airtight casing. The prevents the working gas from leaking out. The hydraulic cylinder is part of a drive device that includes an electric motor and a pump. The pump pumps hydraulic fluid into the hydraulic cylinder to move the hydraulic piston.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 2:
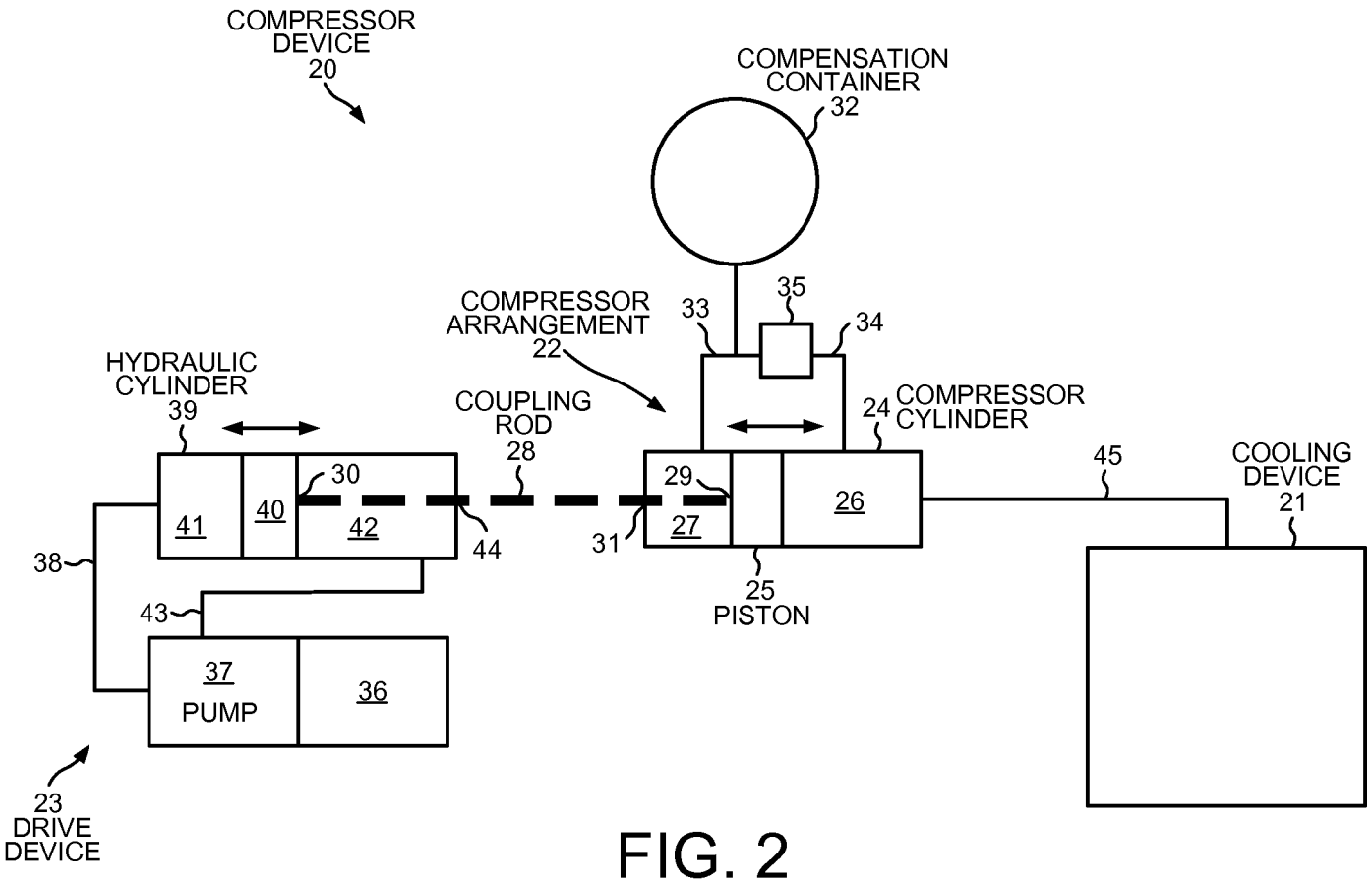
FIG. 2 is a schematic diagram of a first embodiment of the invention in combination with a cooling device.

FIG. 2 shows a first embodiment of the present invention with a compressor device 20 coupled to a cooling device 21. An alternative to a conventional compressor device with a rotary valve is created by combining the compressor device 20 with a compressor element 25, such as a piston, that moves back and forth. The compressor device 20 is then magnetically or mechanically coupled to a drive device 23. By using a fluid compensation container 32 together with the compressor cylinder containing a working medium, such as a gas, the compressor element 25 need only supply the compressing work in one direction of movement, and the volume of the working medium can be reduced. The compensation fluid present in the fluid compensation container 32 is not the working medium. The reduction in the volume of the working medium caused by cooling in the cooling device can thereby be compensated. To this end, a compressor arrangement 22 is subdivided by the compressor element 25 into a first gas volume 26 and a second gas volume 27. The compensation container 32 is connected to the first gas volume 26 by a non-return valve (a one-way value) 35 opening in the direction of the first gas volume 26 and is directly connected via another gas line to the second gas volume 27.

The compensation fluid present in the fluid compensation container 32 is not the working medium, but rather a different gas or a liquid. For example, an oil, in particular an hydraulic oil, can be used as the compensation fluid. The manner of the compression, as regards the time as well as regards the compressor pressure, can be adapted to the particular working medium by the control device. Therefore, the compressor device of the invention can be adapted to different working media so that very different gases can be compressed with the compressor device.

The drive device 23 can be mechanically or magnetically coupled to a plurality of compressor devices. This results in a reduction of costs because only one drive device 23 is necessary. The compressed gas can be made available in the necessary frequency range for Gifford-McMahon coolers and pulse tube coolers by combining the compressor device 20 with the electro-hydrostatic drive device 23, which is mechanically coupled to the compressor element 25. The working medium is thereby periodically compressed by the compressor element 25 and allowed to expand again. The coupling between the electro-hydrostatic drive device 23 and the compressor element 25 is performed by a mechanical or magnetic coupling. The use of rotary valves that produce high losses is therefore eliminated. It is possible by combining the simple controllability of an electric motor with the force of a hydraulic mechanism to construct an extremely efficient compressor that results in a significant reduction of losses on account of the lack of a rotary valve when using Gifford-McMahon coolers or pulse tube coolers. Therefore, a very efficient compressor device is made available.

An especially suitable electro-hydrostatic drive device 23 includes a hydraulic cylinder 39 in which a hydraulic piston 40 is arranged in a linearly movable manner. The hydraulic cylinder 39 is loaded with hydraulic fluid that is supplied and removed via an electrically driven hydraulic pump 37. The hydraulic piston 40 of the hydraulic cylinder 39 is coupled mechanically, e.g., via a rigid rod, or magnetically to the compressor element 25 of the compressor arrangement 22. The direction of movement of the hydraulic piston 40 is controlled by the direction of rotation of the electric motor.

A membrane or a piston can be used as the compressor element 25. On account of the simple construction, a linearly movable piston or a linear piston compressor is preferably used. The advantage of using a membrane as the compressor element 25 is that no piston contact surface has to be sealed. The membrane preferably is made of metal so as to create a tight helium seal.

An electro-hydrostatic drive device that can be used in the novel cooling device is described in German application DE102008025045 B4. Any desired pattern of movement, pressure and frequency of gas change can be transferred onto the compressor device 20 by the electro-hydrostatic drive device 23. The frequency of gas change can be freely adjusted independently of any resonance frequencies. In this manner, the performance of a cooler to be operated with such a compressor device 20 can be optimized and vibrations minimized.

By using an electrically operated hydraulic pump 37, a simple electronic control device can carry out the compression of the working medium in the compressor device 20 according to any desired pattern in time, as well as in accordance with the desired pressure level. The compressor device 20 can be designed as a delivering compressor device, for example, with a traditional cooler unit for the drive that repeatedly compresses and expands a certain gas volume. This is necessary when operating Gifford-McMahon coolers and pulse tube coolers.

In one embodiment, the compressor device 20 includes a coupling rod 28 between the drive device 23 and the compressor arrangement 22 that is designed to include a compressor element 25 or displacement element. A specially designed compressor element 25 that is connected to the coupling rod 25 is therefore not necessary. The compressor cylinder 24 is constructed in such a manner that its cross section is only insignificantly larger than the cross section of the coupling rod 28. The distance between the coupling rod 28 and the inside of the compressor cylinder 24 is as small as possible. Therefore, no seal is required between the coupling rod 218 and the inside of the compressor cylinder 24. The seal and the trapping of the working medium are achieved by an O-ring through which the coupling rod 28 passes on its way into the compressor cylinder 24. The smaller the distance between the coupling rod 28 and the inside of the compressor cylinder 24 and the greater the stroke of the coupling rod 28 in the compressor cylinder, the smaller the dead volume is in the compressor arrangement 22 and the more efficient is the compressor device 20.

FIG. 2 shows that compressor device 20 includes a compressor arrangement 22 driven by an electro-hydrostatic drive device 23. The compressor arrangement 22 includes an airtight compressor cylinder 24 in which a compressor element 25 in the form of a piston is arranged so that it can move in a linear manner. The piston 25 divides the compressor cylinder into a first gas volume 26 and a second gas volume 27. The first gas volume 26 is periodically compressed by the movement of the piston 25, and the working gas, such as helium, is compressed and then expands again. A coupling rod 28 with a first end 29 and a second end 30 is connected by its first end 29 to the piston 25. The coupling rod 28 is run out of the second gas volume 27 of the compressor cylinder 24 through a sealed duct 31 so that the second end 30 of the coupling rod 28 lies outside of the second gas volume 27. A compensation container 32 containing a compensation fluid is directly connected to the second gas volume 27 via a first gas line 33. The compensation container 32 is also connected via a second gas line 34 through a non-return valve 35 to the first gas volume 26. The non-return valve 35 is open in the direction of the first gas volume 26. The compensation fluid present in the second gas volume 27 can flow into the compensation container 32 during the backward movement of the piston 25. Therefore, compression work must be performed only during the forward movement of the piston 25 when the working medium present in the first gas volume 26 is compressed.

The electro-hydrostatic drive device 23 drives the compressor arrangement 22. The electro-hydrostatic drive device 23 includes an electric motor 36 that drives an hydraulic pump 37. The hydraulic pump 37 pumps hydraulic fluid via a first hydraulic line 38 into an hydraulic cylinder 39 in which an hydraulic piston 40 is arranged so that the piston can move linearly. The hydraulic piston 40 divides the hydraulic cylinder 39 into a first partial volume 41 and a second partial volume 42. The first hydraulic line 38 empties into the first partial volume 41, and a second hydraulic line 43 branches off from the second partial volume 42 and runs back into the hydraulic pump 37. The hydraulic piston 40 is moved back and forth in the hydraulic cylinder 39 by the appropriate control of the electric motor 36 and the hydraulic pump 37. The hydraulic piston 40 is connected to the second end 30 of the coupling rod 28, which enters into the second partial volume 42 through a liquid-tight duct 44. Therefore, the movement of the hydraulic piston 40 is transmitted onto the piston 25 so that the gaseous working medium in the first gas volume 26 of the compressor cylinder 24 is periodically compressed by the movement of the hydraulic piston 40 and of the movement of the compressor piston 25 coupled to it. Also, the working pressure range of the compressor device 20 can thereby be stabilized. The reduction of the volume of the working medium resulting from cooling down in the cooling device 21 can thereby be compensated.

The first gas volume 26 of the compressor arrangement 22 is connected via a gas line 45 to the cooling device 21. The cooling device 21 uses periodically compressed gas for its operation. In some embodiments, the cooling device is a Gifford-McMahon cooler or a pulse tube cooler. Thus, in the embodiment of FIG. 2, a fixed amount of gas is periodically compressed in the first gas volume 26 and then allowed to expand again.

Figure 1:
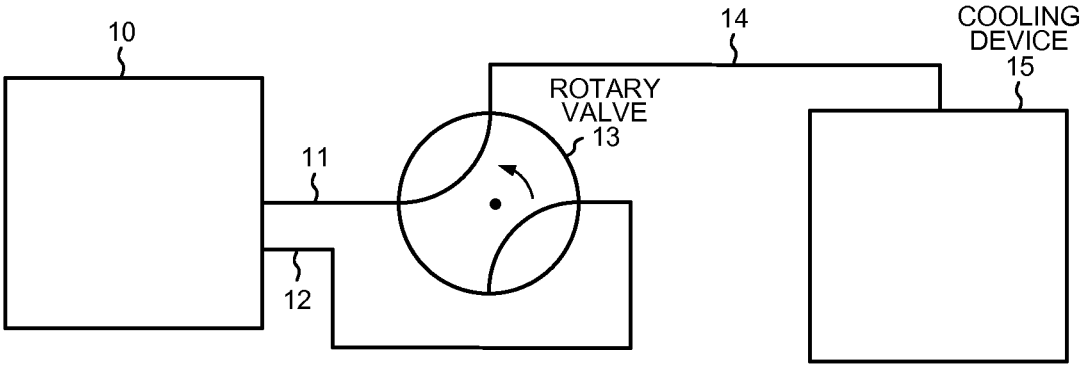
(PRIOR ART) FIG. 1
FIG. 1 (prior art) is a schematic diagram of a conventional helium compressor device with a rotary valve and a cooling device.
Figure 3:
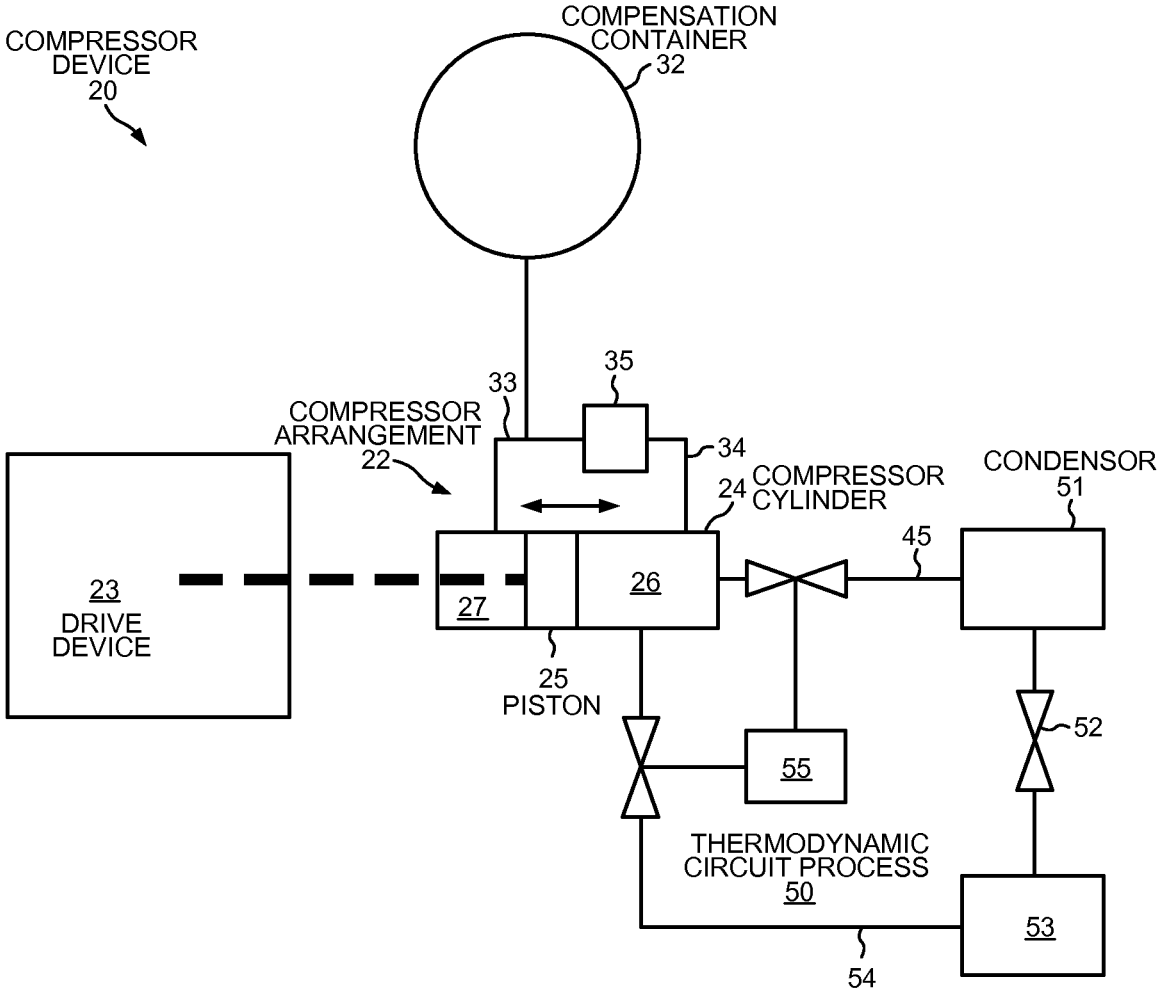
FIG. 3 shows a second embodiment of the invention in combination with a traditional cooler unit.

FIG. 3 shows a second embodiment of the invention in which the compressor device 20 delivers the working medium and drives a thermodynamic circuit process 50 of a heat pump or a cooler unit with it. The first gas volume 26 in the compressor cylinder 24 is connected via the gas line 45 to a condenser 51. The gaseous working medium is condensed in the condenser 51 with the loss of heat. The liquid working medium is supplied via a throttle 52 to an evaporator 53. The liquid working medium is evaporated in the evaporator 53 while receiving heat. The gaseous working medium is supplied via a gas line 54 back to the first gas volume 26 in the compressor cylinder 24. The exchange of gas in and out of the first gas volume 26 is controlled via a valve control device 55.

Different embodiments and variations of the compressor device 20 are now explained below in relation to FIGS. 4-8.

Figure 4:
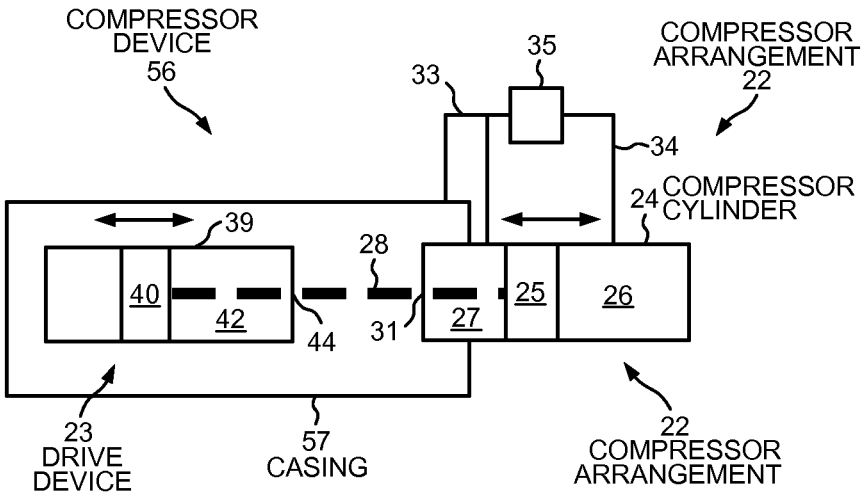
FIG. 4 shows a third embodiment of a novel compressor device in accordance with the invention.

FIG. 4 shows a third embodiment of the invention with a compressor device 56 that differs from the compressor device 20 in accordance with the first embodiment only in that the hydraulic cylinder 39 and the coupling rod 28 are disposed in a common airtight casing 57 between the hydraulic piston 40 and the compressor element 25. The duct 31 for the coupling rod 28 from the second gas volume 27 and the duct 44 into the second partial volume 42 of the hydraulic cylinder 39 are also arranged inside the airtight casing 57. This prevents gaseous working medium from the first gas volume 26 from exiting through the second gas volume 27 and through the duct 31. This is especially important if helium is used as the working medium because helium is very expensive. The airtight casing 57 also acts as the compensation container 32 for the working medium.

Figure 5:
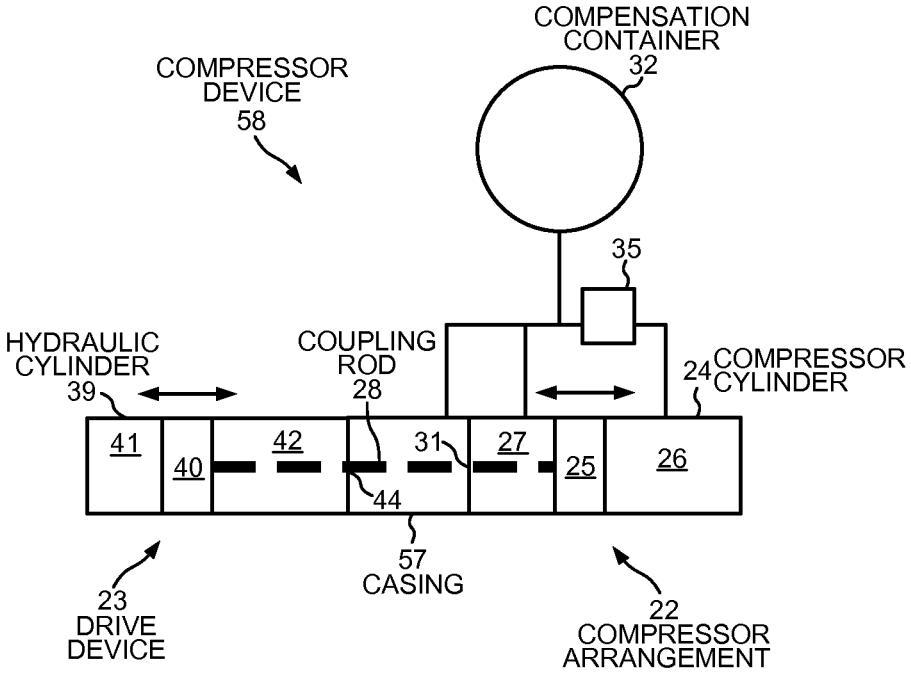
FIG. 5 shows a fourth embodiment of a novel compressor device in accordance with the invention.

FIG. 5 shows a fourth embodiment with a compressor device 58 that also reduces the problem of helium leakage. The embodiment of FIG. 5 differs from the embodiment of FIG. 4 in that the airtight casing 57 is limited to the area between the drive device 23 and the compressor arrangement 22. The coupling rod 28, the liquid-tight duct 44 and the airtight duct 31 are arranged inside the airtight casing 57. Because the gas volume enclosed by the airtight casing 57 is comparatively small, a separate compensation container 32 is provided in the embodiment of FIG. 5.

Figure 6:
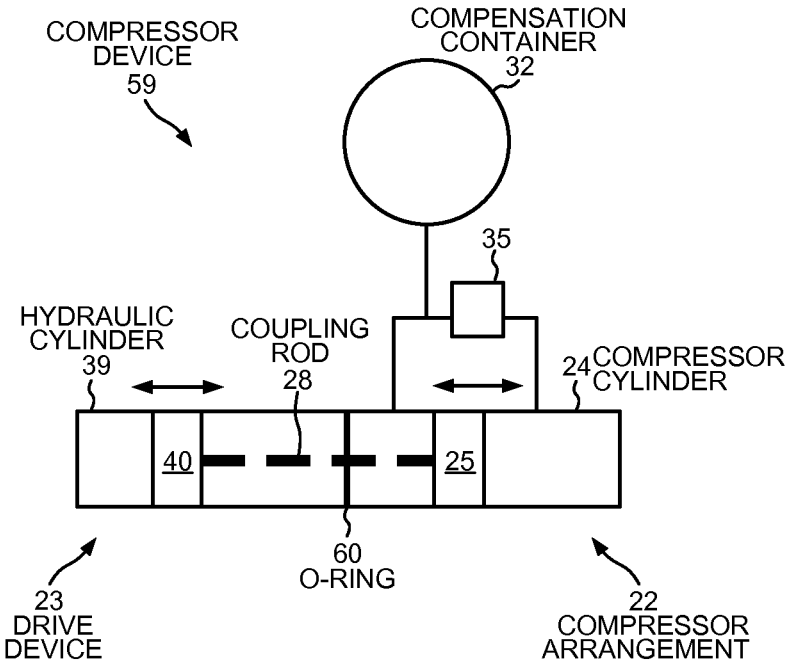
FIG. 6 shows a fifth embodiment of a novel compressor device in accordance with the invention.

FIG. 6 shows a fifth embodiment of the invention that also reduces the problem of helium leakage. FIG. 6 shows a compressor device 59 in which the hydraulic cylinder 39 is directly connected to the compressor cylinder 24 of the compressor arrangement 22. The connection location of the hydraulic cylinder 39 and of the compressor cylinder 24 is made airtight with an O-ring 60. In this manner, the rigid mechanical connection between hydraulic piston 40 and compressor element 25, which are connected by coupling rod 28, is also enclosed inside an airtight casing.

Figure 7:
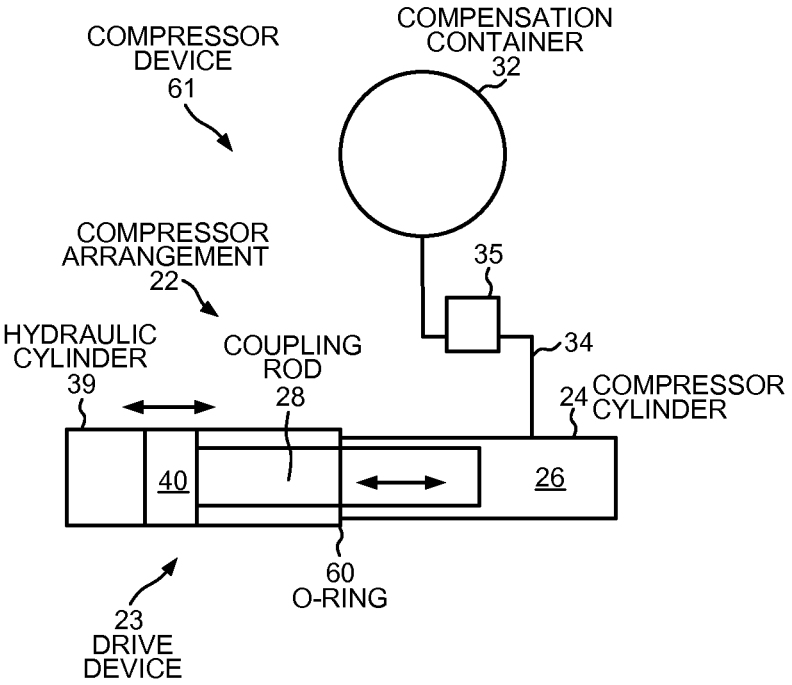
FIG. 7 shows a sixth embodiment of a novel compressor device in accordance with the invention.

FIG. 7 shows a sixth embodiment of the invention in which one end of the coupling rod 28 functions as the compressor element 25. The hydraulic cylinder 39 of compressor device 61 is directly connected to the compressor cylinder 24, and the connection location of the hydraulic cylinder 39 and the compressor cylinder 24 is made airtight with an O-ring 60. In contrast to the fifth embodiment of FIG. 6, the end of the coupling rod 28 of compressor device 61 that extends into the compressor cylinder 24 is constructed as a compressor element or piston. Thus, the compressor element 25 is an integral part of the coupling rod 28. A separate compressor element is therefore not necessary. The compressor cylinder 24 defines only a first gas volume 26 that is periodically reduced and then enlarged. The compensation container 32 for the working medium is connected via the gas line 34 with non-return valve 35 to this single gas volume 26. The cross section and inside diameter of the compressor cylinder 24 are only insignificantly larger than the cross section and outside diameter of the coupling rod 28. The distance between coupling rod 28 and the inside of the compressor cylinder 24 is as small as possible so that no seal need be used between coupling rod 28 and the inside of the compressor cylinder 24. The sealing and the trapping of the working medium is performed by the O-ring 60 in the duct of the coupling rod 28 into the compressor cylinder 24. The smaller the distance between coupling rod 28 and the inside of the compressor cylinder 24 and the larger the stroke of the coupling rod 28 into the compressor cylinder 24, the smaller the dead volume in the compressor device 61 and the more efficient the compressor device 61 is.

Figure 8:
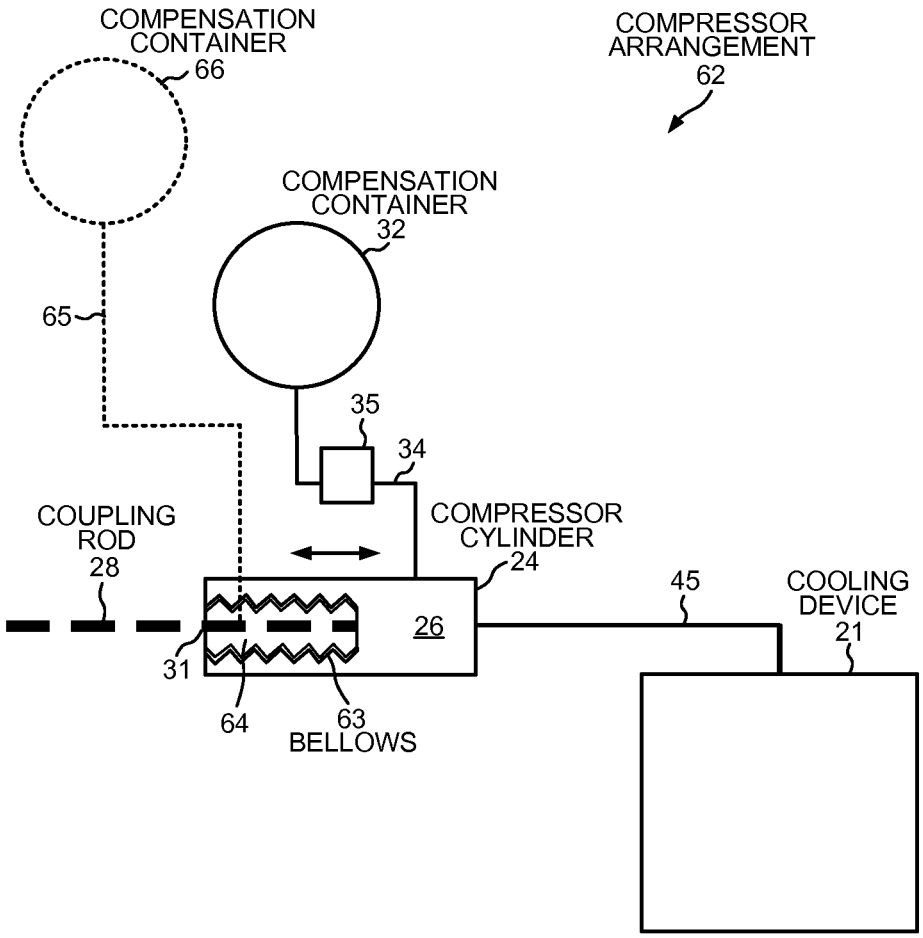
FIG. 8 shows a seventh embodiment of a novel compressor device in accordance with the invention.

FIG. 8 shows a compressor arrangement 62 of a seventh embodiment of the invention in which the compressor is arranged separately from the drive device. The end of the coupling rod 28 that extends into the compressor cylinder 24 is surrounded by an airtight bellows 63 that forms, together with the end of the coupling rod 28 extending into the compressor cylinder 24, the compressor element of compressor arrangement 62. The bellows 63 are connected in an airtight manner to the inside of the compressor cylinder 24. By doing so, the duct 31 through which the coupling rod 28 enters the compressor cylinder 24 does not have to be airtight. The seal of the gas volume 26 to be compressed is provided by the bellows 63. However, if the duct 31 is constructed to be airtight, the volume 64 inside the bellows 63 must be directly connected via a gas line 65 to another fluid compensation container 66. The compensation fluid present in the fluid compensation container 66 is not the working medium, but rather another gas or a liquid. For example, an oil, in particular hydraulic oil, can be used as the compensation fluid.

Figure 9:
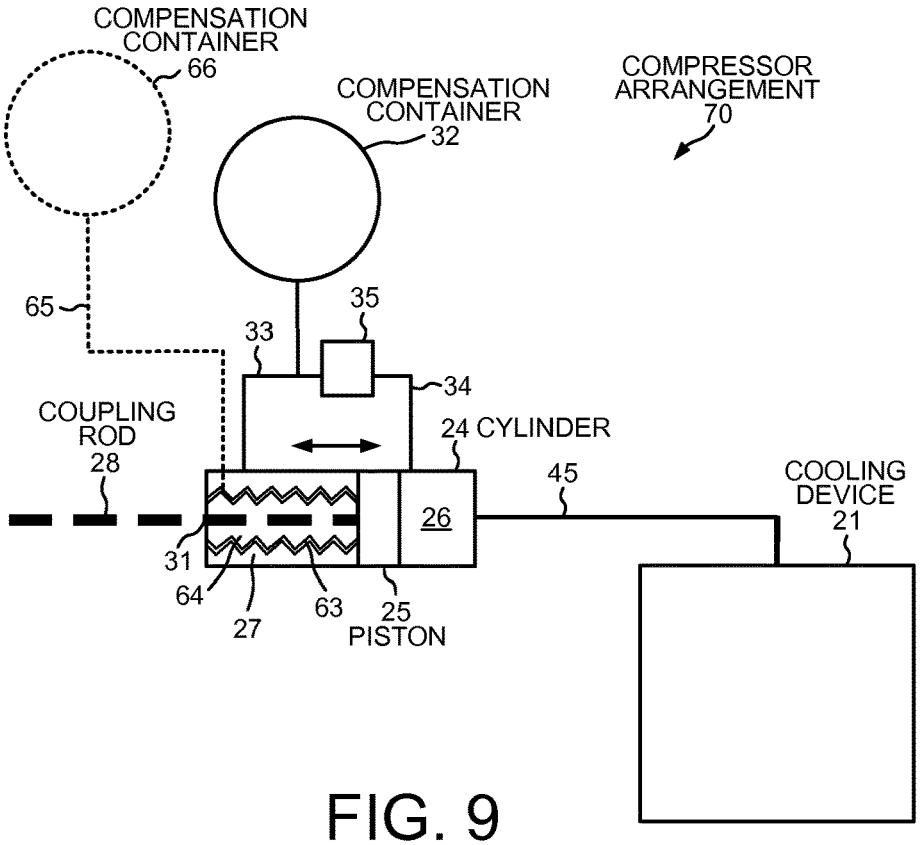
FIG. 9 shows an eighth embodiment of a novel compressor device in accordance with the invention.

FIG. 9 shows a compressor arrangement 70 of an eighth embodiment of the invention. The compressor arrangement 70 differs from the compressor arrangement 62 solely in that a compressor element in the form of a piston 25 is again arranged at the end of the coupling rod 28 and allows the bellows 63 to be connected to the compressor element 25. The piston 25 divides the compressor cylinder 24 into the first gas volume 26 and the second gas volume 27. The compensation container 32 for the working medium is directly connected by the gas line 33 to the second gas volume 27 as well as through the gas line 34 with its non-return valve 35 to the first gas volume 26. Again, the gas volume 64 enclosed by the bellows 63 must be connected to a compensation container 66 if the duct 31 is constructed to be airtight.

Figure 10:
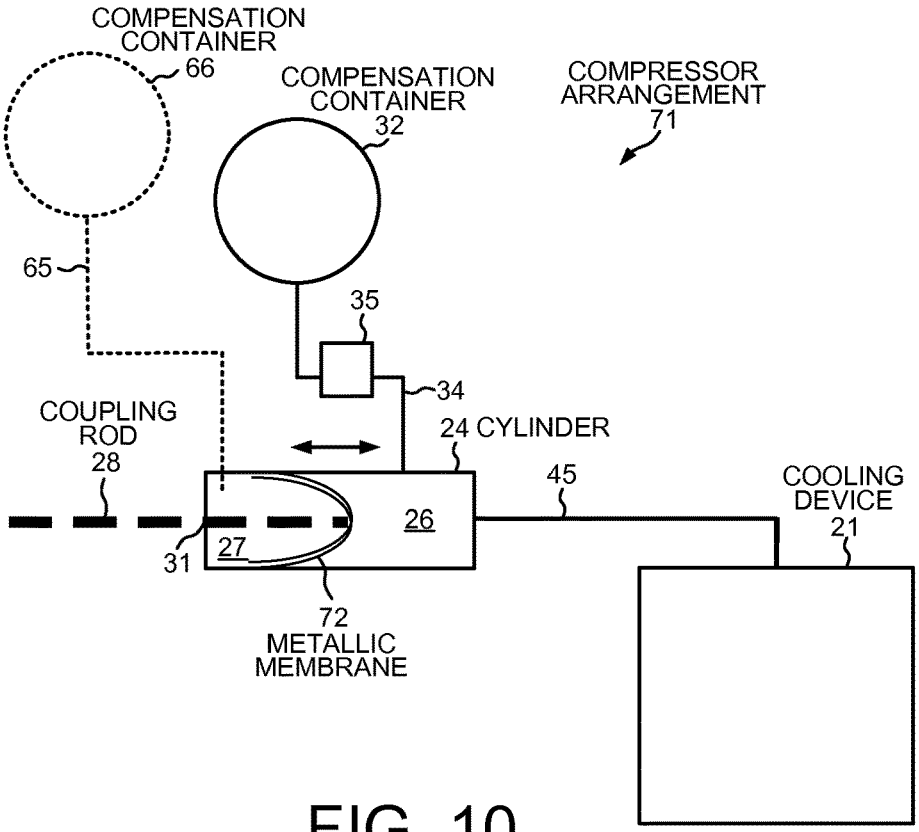
FIG. 10 shows a ninth embodiment of a novel compressor device in accordance with the invention.

FIG. 10 shows a compressor arrangement 71 of a ninth embodiment of the invention. The compressor arrangement 71 differs from the compressor arrangement 22 of FIG. 2 in that the compressor element is not designed as a piston but rather as a metallic membrane 72. The end of the coupling rod 28 is centrally connected to the membrane 72. The membrane 72 divides the compressor cylinder 24 into the first gas volume 26 and the second gas volume 27. The compensation container 32 for the working medium is directly connected via the gas line 34 with its non-return valve 35 to the first gas volume 26. The second gas volume 27 that is separated from the first volume 26 by the membrane 72 must only be connected to a compensation container 66 if the duct 31 is airtight.

Figure 11:
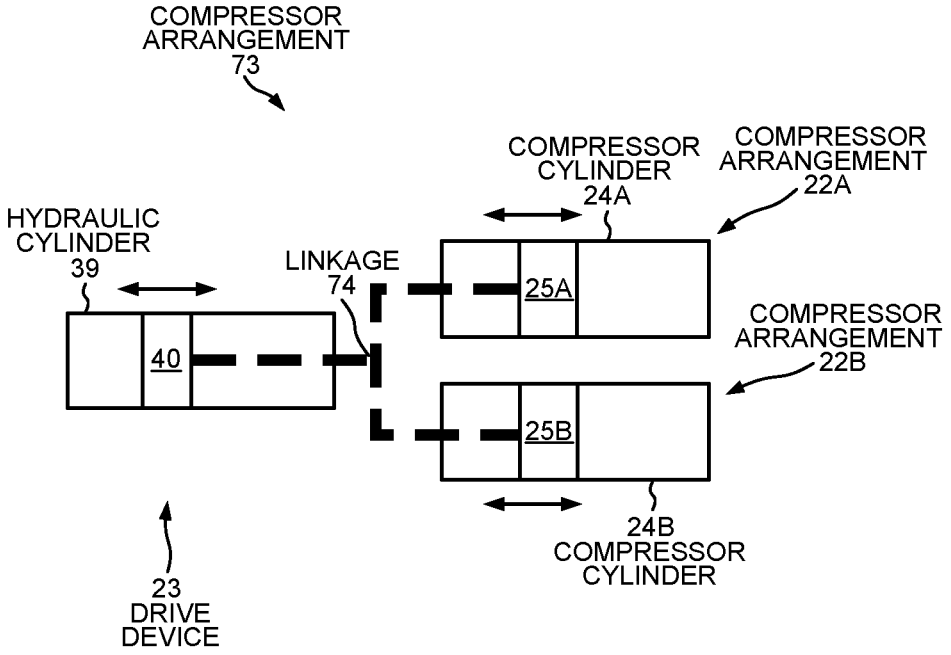
FIG. 11 shows a tenth embodiment of a novel compressor device in accordance with the invention.

FIG. 11 shows a tenth embodiment of the invention with a novel compressor arrangement 73. The compressor arrangement 73 includes a plurality of individual compressor arrangements, such as a first compressor arrangement 22A and a second compressor arrangement 22B, that are driven by a single electro-hydrostatic device 23. The hydraulic piston 40 is mechanically coupled via a fork-shaped linkage 74 to a first compressor element 25A of a first compressor cylinder 24A and also to a second compressor element 25B in a second compressor cylinder 24B. In this manner, several compressor arrangements 22A-B and therefore several cooling devices can be operated with one electro-hydrostatic drive device 23.

Figure 12:
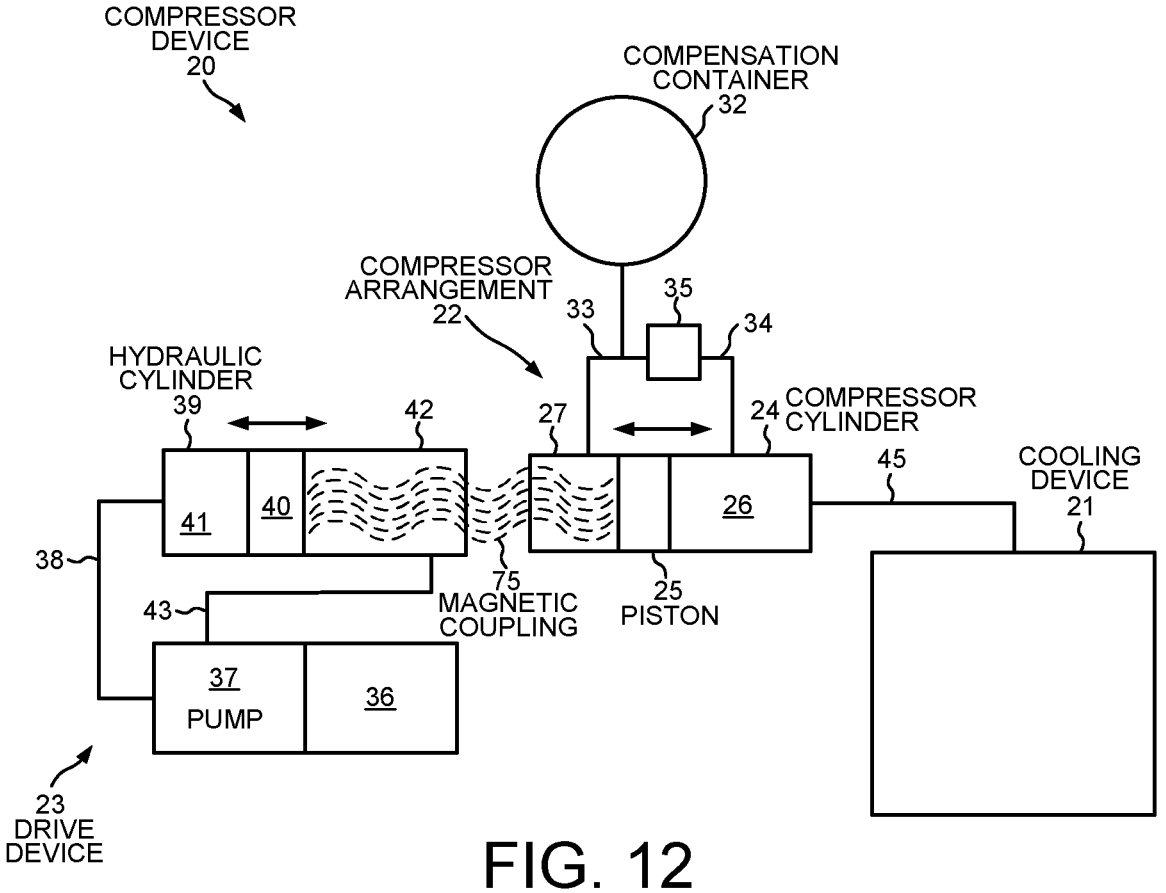
FIG. 12 shows a modification to the embodiment of FIG. 2 in which the hydraulic piston and the compressor element are magnetically coupled instead of being coupled by a coupling rod.

Instead of the rigid mechanical coupling via the coupling rod 28, the hydraulic piston 40 and the compressor element 25 can also be magnetically coupled 75 to one another, as shown in FIG. 12. The advantage of a magnetic coupling is that no ducts 31, 44 for the coupling rod 28 are required in the compressor cylinder 24 of the compressor arrangement 22 and in the hydraulic cylinder 39. By avoiding the use of ducts, any leaking of helium from the compressor cylinder 24 can be eliminated.

LIST OF REFERENCE NUMERALS

10 helium compressor
11 high-pressure line
12 low-pressure line
13 rotary valve
14 gas line
15 cooling device
20 compressor device
21 cooling device
22 compressor arrangement
23 electro-hydrostatic drive device
24 compressor cylinder
25 compressor element (piston)
26 first gas volume
27 second gas volume
28 coupling rod
29 first end of 28
30 second end of 28
31 airtight duct in 24
32 compensation container for working medium
33 first gas line
34 second gas line
35 non-return valve
36 electric motor
37 hydraulic pump
38 first hydraulic line
39 hydraulic cylinder
40 hydraulic piston
41 first partial volume in 39
42 second partial volume in 39
43 second hydraulic line
44 liquid-tight duct
45 gas line
50 thermodynamic circuit process
51 condenser
52 throttle
53 evaporator
54 gas line
55 valve control device
56 compressor device
57 gas-tight casing

58 compressor device
59 compressor device
60 O-ring
61 compressor device
62 compressor arrangement
63 bellows
64 volume inside 63
65 gas line
66 fluid compensation container
70 compressor arrangement
71 compressor arrangement
72 membrane
73 compressor device
74 fork-shaped linkage Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A device comprising:

a compressor arrangement with a compressor element, wherein the compressor element divides the compressor arrangement into a first volume and a second volume, and wherein the first volume contains a working gas that is compressed by the compressor element;

a hydraulic cylinder with a hydraulic piston, wherein the hydraulic piston is coupled to the compressor element;

a compensation container connected to the first volume by a gas line with a non-return valve that opens in the direction of the first volume, wherein the compensation container is connected by the gas line to the second volume, wherein the working gas flows between the compensation container and the second volume, and wherein the working gas flows from the compensation container to the first volume; and a cooling device, wherein the first volume is connected to the cooling device such that compressed working gas from the first volume flows into the cooling device and expands in the cooling device.

2. The device of claim 1, wherein the second volume is connected to the first volume by the gas line, and wherein the non-return valve prevents the working gas from flowing from the first volume into either the compensation container or the second volume.

3. The device of claim 1, wherein the working gas is helium.

4. The device of claim 1, wherein the hydraulic piston is coupled to the compressor element by a rigid rod.

5. The device of claim 1, wherein the compressor element is a membrane.

6. The device of claim 5, wherein the membrane is made of metal.

7. The device of claim 1, wherein the compressor element includes a bellows.

8. The device of claim 1, wherein the working gas is periodically compressed in the first volume and then allowed to expand again in the first volume.

9. The device of claim 1, wherein the cooling device is taken from the group consisting of: a Gifford-McMahon cooler and a pulse tube cooler.

10. The device of claim 1, wherein the hydraulic piston divides the hydraulic cylinder into a first partial volume and a second partial volume, and wherein the second volume and the first partial volume are connected by an airtight casing.

11. A device comprising:

a compressor cylinder with a compressor piston, wherein the compressor piston divides the compressor cylinder into a first volume and a second volume, and wherein the first volume contains a working gas that is compressed by the compressor piston;

a hydraulic cylinder with a hydraulic piston, wherein the hydraulic piston is coupled to the compressor piston;

a compensation container that is connected to the first volume and the second volume such that the working gas can flow between the compensation container and the second volume and from the compensation container and the second volume to the first volume; and a cooling device, wherein the first volume is connected to the cooling device such that compressed working gas from the first volume flows into the cooling device and expands in the cooling device.

12. The device of claim 11, wherein the compensation container is connected to the first volume by a gas line with a non-return valve opening in the direction of the first volume.

13. The device of claim 11, wherein the hydraulic piston is coupled to the compressor piston by a rigid rod.

14. The device of claim 13, wherein the compressor piston is an integral part of the rigid rod.

15. The device of claim 13, wherein the compressor piston is formed by an end of the rigid rod opposite the hydraulic piston.

16. The device of claim 11, wherein the hydraulic piston is magnetically coupled to the compressor piston.

17. The device of claim 11, wherein the hydraulic cylinder is part of a drive device that includes an electric motor and a pump, and wherein the pump pumps hydraulic fluid into the hydraulic cylinder to move the hydraulic piston.

18. The device of claim 11, further comprising:

a second compressor cylinder with a second compressor piston, wherein the second compressor piston is coupled to the hydraulic piston.

19. The device of claim 11, wherein the compressor piston compresses the working gas in the first volume with a frequency between 0.5 and 5 Hz.

20. The device of claim 11, wherein the cooling device is taken from the group consisting of: a Gifford-McMahon cooler and a pulse tube cooler.

21. The device of claim 11, wherein the device does not include a rotary valve.

22. A compressor device comprising:

a compressor arrangement with a compressor element, wherein the compressor element divides the compressor arrangement into a first volume and a second volume, and wherein the first volume contains a working gas that is compressed by the compressor element;

a drive device with a piston, wherein the piston is coupled to the compressor element;

a compensation container that is directly connected to the second volume, wherein the compensation container is connected to the first volume by a gas line with a non-return valve that opens in the direction of the first volume; and a cooling device, wherein the first volume is connected to the cooling device such that compressed working gas from the first volume flows into the cooling device and expands in the cooling device.

23. The compressor device of claim 22, wherein the compressor arrangement and the drive device are connected by an airtight casing.

24. The compressor device of claim 22, wherein the compressor device does not include a rotary valve.

25. The compressor device of claim 22, wherein the compressor element includes a bellows.

* * * * *